US008287622B2

(12) United States Patent
Li et al.

(10) Patent No.: US 8,287,622 B2
(45) Date of Patent: Oct. 16, 2012

(54) METHOD FOR MAKING ALUMINUM-BASED COMPOSITE MATERIAL

(75) Inventors: Wen-Zhen Li, Beijing (CN); Shi-Ying Liu, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 15 days.

(21) Appl. No.: 12/833,949

(22) Filed: Jul. 10, 2010

(65) Prior Publication Data

US 2011/0154953 A1 Jun. 30, 2011

(30) Foreign Application Priority Data

Dec. 25, 2009 (CN) ..... 2009 1 0239051

(51) Int. Cl.
*C22B 21/06* (2006.01)

(52) U.S. Cl. ..... 75/684; 75/686; 148/549; 148/558; 164/900

(58) Field of Classification Search ..... 75/686, 75/684; 148/558, 549; 164/900
See application file for complete search history.

(56) References Cited

U.S. PATENT DOCUMENTS

| | | | | |
|---|---|---|---|---|
| 3,936,298 | A * | 2/1976 | Mehrabian et al. | 148/400 |
| 6,308,768 | B1 * | 10/2001 | Rice et al. | 164/133 |
| 6,769,473 | B1 * | 8/2004 | Adachi et al. | 164/71.1 |
| 6,860,314 | B1 | 3/2005 | Koide et al. | |
| 7,216,690 | B2 * | 5/2007 | Han et al. | 164/113 |
| 7,509,993 | B1 | 3/2009 | Turng et al. | |
| 7,712,512 | B2 | 5/2010 | Suganuma et al. | |
| 7,837,811 | B2 * | 11/2010 | Motegi et al. | 148/538 |
| 2009/0162574 | A1 | 6/2009 | Li et al. | |

FOREIGN PATENT DOCUMENTS

| | | |
|---|---|---|
| CN | 101439407 A | 5/2009 |
| JP | 58100643 | 6/1983 |
| JP | 2004136363 | 5/2004 |
| JP | 2007331005 | 12/2007 |

* cited by examiner

*Primary Examiner* — George Wyszomierski
*Assistant Examiner* — Tima M McGuthry Banks
(74) *Attorney, Agent, or Firm* — Altis Law Group, Inc.

(57) ABSTRACT

The present disclosure provides a method for making aluminum-based composite material. The method includes the following steps. First, a aluminum-based material in semi-solid state is provided. Second, at least one nanoscale reinforcement is added into the aluminum-based material in semi-solid state to obtain a mixture in semi-solid state. Third, the mixture in semi-solid state is heated to a mixture in liquid state. Fourth, the mixture in liquid state is ultrasonically processed. Fifth, the mixture in liquid state is cooled to obtain the aluminum-based composite material.

19 Claims, 3 Drawing Sheets

METHOD FOR MAKING ALUMINUM-BASED COMPOSITE MATERIAL

CROSS-REFERENCE TO RELATED APPLICATIONS

This application claims all benefits accruing under 35 U.S.C. §119 from China Patent Application No. 200910239051.9, filed on 2009/12/25, in the China Intellectual Property Office, the disclosure of which is incorporated herein by reference. This application is related to commonly-assigned application entitled, "METHOD FOR MAKING MAGNESIUM-BASED COMPOSITE", filed on Jul. 10, 2010 with an Application No. 12/833950.

BACKGROUND

1. Technical Field

The present disclosure relates to a method for making an aluminum-based composite material.

2. Description of Related Art

Presently, aluminum-based composite material is attracting a great deal of attention for its good specific strength, specific stiffness, abrasion resistance, and high temperature resistance. The properties of the aluminum-based composite material relates to a size of reinforcements dispersed in the aluminum-based composite material. The smaller the size of the reinforcements, the better the properties of the aluminum-based composite material, but the reinforcements are not easily dispersed into the aluminum-based composite material uniformly because the size of the reinforcements is too small.

To address the above-described problem, a high intensity ultrasonic processing can effectively disperse the reinforcements. During the high intensity ultrasonic processing, a mechanical effect of an ultrasonic cavitation effect can hasten the dispersion of the reinforcements into the aluminum-based material, but the high intensity ultrasonic processing can only disperse the reinforcements in very localized areas. The reinforcements trend to stay on a surface of the aluminum-based material and are not easily dispersed uniformly in all the aluminum-based material. In many local areas, a density of the reinforcements may be different.

What is needed, therefore, is to provide a method for making an aluminum-based composite material in which the nanoscale reinforcements are dispersed uniformly.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
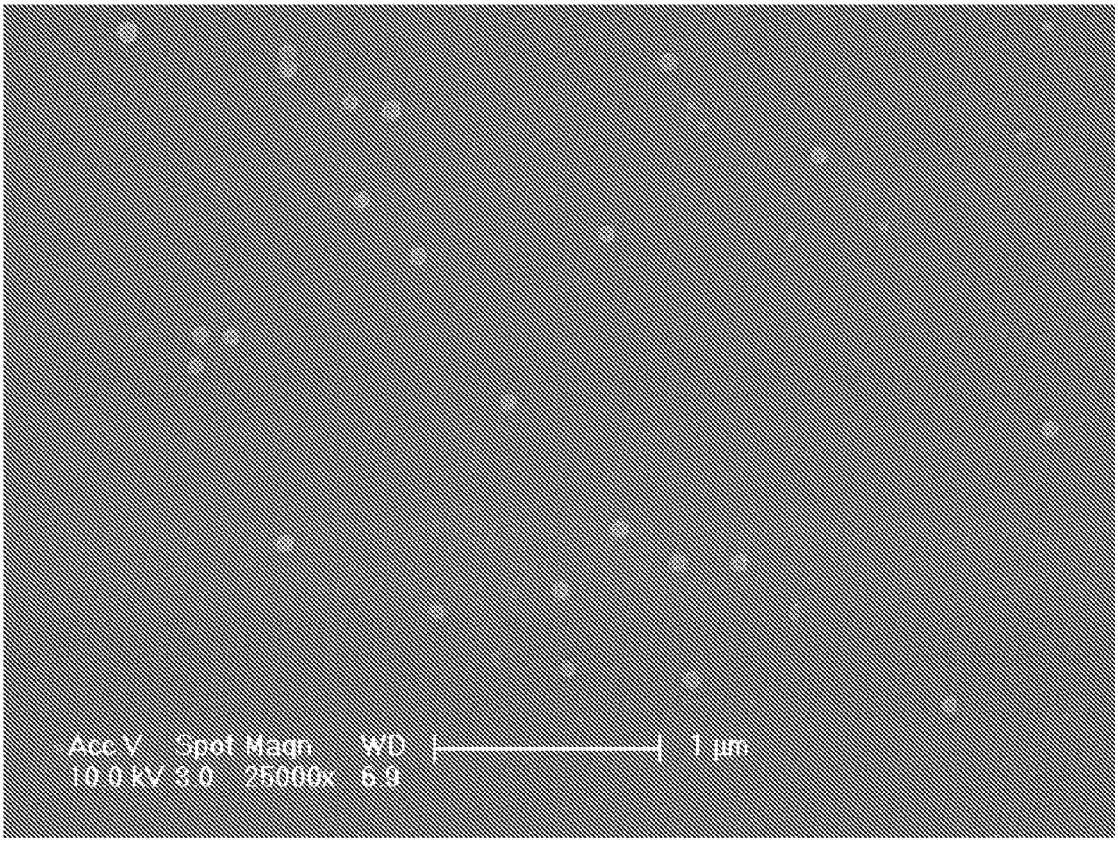
FIG. 1 illustrates a transmission electron microscope image of an embodiment of an aluminum-based composite material according to example 1.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

An embodiment of a method for making an aluminum-based composite material includes the following steps:

S10, providing a aluminum-based material in semi-solid state;

S20, adding at least one nanoscale reinforcement into the aluminum-based material in semi-solid state to obtain a mixture in semi-solid state;

S30, heating the mixture in semi-solid state to a liquid state;

S40, ultrasonically processing the mixture in liquid state under high intensity;

S50, cooling the mixture in liquid state to obtain the aluminum-based composite material.

In step S10, the aluminum-based material can be pure aluminum or aluminum-based alloys. The aluminum-based alloys include aluminum (Al) and other metals such as copper (Cu), silicon (Si), magnesium (Mg), zinc (Zn), manganese (Mn), nickel (Ni), iron (Fe), titanium (Ti), germanium (Ge), lithium (Li), or any combinations thereof.

In one embodiment, a method for making the semi-solid aluminum-based material includes the following steps:

S101, providing a aluminum-based material in solid state;

S102, heating the aluminum-based material in solid state to a temperature between a liquidus line and a solidus line of the aluminum-based material to obtain a aluminum-based material in semi-solid state; and S103, keeping the aluminum-based material in the semi-solid state for a period of time.

In S101, the aluminum-based material in solid state can be a plurality of pure aluminum particles, a plurality of aluminum-based alloy particles or an aluminum-based alloy casting.

In S102, an electric resistance furnace can heat the aluminum-based material in solid state. The electric resistance furnace can be an electric resistance crucible furnace. The aluminum-based material in solid state can be disposed in an argil-graphite crucible or a stainless steel container before heating. The aluminum-based material can be provided in a protective gas or a vacuum. The protective gas or vacuum can prevent the aluminum in the aluminum-based material from being oxidated or burning. In one embodiment, the protective gas exists during step 10, step 20, step 30, step 40, and step 50.

In S103, the aluminum-based material is kept in a semi-solid state, in a time ranging from about 10 minutes to about 60 minutes to avoid the solid aluminum-based material existing in local regions of the aluminum-based material in semi-solid state.

In one embodiment, another method for making the aluminum-based material in semi-solid state includes the following steps:

S111, providing a aluminum-based material in solid state;

S112, heating the aluminum-based material in solid state to a temperature 50° C. higher than the liquidus lines of the aluminum-based material to obtain a aluminum-based material in liquid state; and S113, decreasing the temperature of the aluminum-based material in liquid state to a temperature between the liquidus line and the solidus line of the aluminum-based material to obtain the aluminum-based material in semi-solid state.

This method allows the materials both inner portion and outer portion of the aluminum-based material in semi-solid state.

In step S20, the nanoscale reinforcements can be carbon nanotubes (CNTs), silicon carbides (SiC), aluminum oxides ($Al_2O_3$), boron carbides ($B_4C$) or any combinations thereof. The weight percentage of the nanoscale reinforcements in the aluminum-based composite material can range from about 0.5% to about 5.0%. In one embodiment, the weight percentage of the nanoscale reinforcements in the aluminum-based composite material can range from about 0.5% to about 2.0% to prevent the nanoscale reinforcements from aggregating. The nanoscale reinforcements can be particles with diameters ranging from about 1.0 nanometer to about 100 nanometers. An outer diameter of each CNT can range from about 10 nanometers to about 50 nanometers. A length of each CNT can range from about 0.1 micrometers to about 50 micrometers. Before being added to the semi-solid aluminum-based material, the nanoscale reinforcements can be heated to a temperature in a range from about 300° C. to about 350° C. for removing water absorbed by the surfaces of the nanoscale reinforcements. Therefore, the wettability between the nanoscale reinforcements and the aluminum-based material will be enhanced.

In one embodiment, the aluminum-based material can be stirred during the process of adding the nanoscale reinforcements therein to uniformly disperse the nanoscale reinforcements into all of the aluminum-based material. The method for stirring the aluminum-based material can be intense agitation. A method of the intense agitation can be an ultrasonic stirring or an electromagnetic stirring. An electromagnetic stirrer can implement the method of the electromagnetic stirring. A device having a number of agitating vanes can implement the method of the ultrasonic stirring. The agitating vanes can be two-layer type or three-layer type. The speed of the agitating vanes can range from about 200 r/min to about 500 r/min. The time of the intensely agitating can range from about 1 minute to about 5 minutes.

When the aluminum-based material is stirred, the nanoscale reinforcements are added into the aluminum-based material slowly and continuously to uniformly disperse the nanoscale reinforcements. If the nanoscale reinforcements are added into the aluminum-based material all at once, the nanoscale reinforcements will be aggregated to form a number of nanoscale reinforcement clusters. In one embodiment, the nanoscale reinforcements are added into the aluminum-based material via a steel tube. In other embodiments, the nanoscale reinforcements are added into the aluminum-based material via a funnel or a sifter having a plurality of nanosize holes. By the above methods, the speed of adding the nanoscale reinforcements can be controllable so that the nanoscale reinforcements are dispersed into the aluminum-based material uniformly.

Since the aluminum-based material in semi-solid state is soft, the nanoscale reinforcements can be easily added into the aluminum-based material and prevented from being damaged. Furthermore, since a viscous resistance of aluminum-based material in semi-solid state is large, the nanoscale reinforcements are astricted in the aluminum-based material and are hard to rise and fall. A swirl is produced when the aluminum-based material is being stirred. Following the centrifugal force of the swirl motion, the nanoscale reinforcements can be dispersed into all the aluminum-based material uniformly. Therefore, the nanoscale reinforcements are uniformly dispersed into all the aluminum-based material in step S20.

In step S30, the mixture in semi-solid can be heated to a liquid mixture in the protective gas. The temperature of the mixture in semi-solid is increased to a temperature higher than the liquidus line to obtain the liquid mixture. By increasing the temperature of the resistance furnace, the temperature of the mixture in semi-solid state is increased following the temperature of the resistance furnace. The dispersal of the nanoscale reinforcements has no change during the processing of heating the mixture in semi-solid state.

In step S40, the ultrasonic processing can uniformly disperse the nanoscale reinforcements in localized areas of the mixture in liquid state. An ultrasonic probe is dipped into the mixture in liquid state in a depth of about 20 millimeters to about 50 millimeters. A frequency of the ultrasonic processing can range from about 15 KHz to about 20 KHz. A maximum output power of the processing can range from about 1.4 KW to about 4 KW. A time for the ultrasonic processing can range from about 10 minutes to about 30 minutes. The larger the quantity of the nanoscale reinforcements, the longer the time it takes for the ultrasonic processing, and vice versa.

In the liquid-state, the viscous resistance of the mixture is small and a fluidity of the liquid mixture is good. During the ultrasonic processing, an ultrasonic cavitation effect of the mixture in liquid state is stronger than an ultrasonic cavitation effect of the mixture in semi-solid state. The effect of the ultrasonic cavitation can break the nanoscale reinforcement clusters in localized areas of the mixture in liquid state. The nanoscale reinforcements are uniformly dispersed in both macroscopy and microcosmos in step S40.

In step S50, the way of cooling the mixture in liquid state can be furnace cooling or natural convection cooling. In one embodiment, a method for cooling the mixture in liquid state can include the following steps:

S51, increasing the temperature of the mixture in liquid state to a pouring temperature;

S52, providing a mold;

S53, pouring the mixture in liquid state into the mold; and

S54, cooling the mold.

In step S51, the pouring temperature is a temperature of the mixture in liquid state, which is to be poured into the mold. The pouring temperature is higher than the temperature of the liquidus lines of the liquid mixture. The pouring temperature can range from about 650° C. to about 680° C. The larger the quantity of the nanoscale reinforcements, the higher the pouring temperature that is needed, and vice versa.

In step S52, the material of the mold is metal. The mold can be preheated. The preheated temperature of the mold can range from about 200° C. to about 300° C. The preheated temperature of the mold has an effect on the properties of the aluminum-base composite material. If the preheated temperature of the mold is too low, the mold cannot be entirely filled by the mixture in liquid state, and shrink holes may be formed in the aluminum-based composite material. If the temperature of the mold is too high, a size of the grains of the aluminum-based composite material will be too large such that the performance of the aluminum-based composite material will be reduced.

EXAMPLE 1 a method for making an aluminum-based composite material is provided. The components of the aluminum-based composite material are SiC and ADC12 aluminum alloy. The weight percentage of the SiC in the aluminum-based composite material is about 0.5 wt %. The method includes the following steps:

S111, providing 3 kilograms of an electrical resistant furnace and ADC12 aluminum alloy;

S112, heating the ADC12 aluminum alloy to about 650° C. using the electrical resistant furnace;

S113, decreasing the temperature of the aluminum-based alloy to about 550° C. and keeping the ADC12 aluminum alloy at about 550° C. for about 30 minutes to obtain a ADC12 aluminum alloy in semi-solid state;

S114, mechanically stirring the semi-solid ADC12 aluminum alloy and adding 15 grams of SiC particles into the ADC12 aluminum alloy during the ultrasonic stirring to obtain a mixture in semi-solid state;

S115, increasing the temperature of the mixture in semi-solid state to about 620° C. to obtain a mixture in liquid state;

S116, ultrasonically processing the liquid mixture under high intensity;

S117, increasing the temperature of the mixture in liquid state to about 650° C. and pouring the mixture in liquid state into a mold; and S118, cooling the mold to obtain the aluminum-based composite material.

In step S114, a speed of the ultrasonic stirring ranges from about 200 r/min to about 300 r/min, an average diameter of the SiC particles is about 40 nanometers. The SiC particles are preheated before being added into the ADC12 aluminum alloy in semi-solid state. A temperature that the SiC particles are preheated ranges from about 200° C. to about 300° C. A time for adding the SiC particles is about 1 minute. In step S116, a frequency of the ultrasonic processing is about 20 KHz, a maximum power output of the ultrasonic processing is about 1.4 KW, and a time of the ultrasonic processing is about 10 minutes.

In step S117, the mold is preheated to a temperature of about 210° C.

Referring to FIG. 1, a plurality of SiC particles is dispersed in the aluminum-based composite material. The plurality of SiC particles is dispersed uniformly and will not be aggregated. Compared to the ADC12 aluminum alloy, a tensile strength of the aluminum-based composite material including SiCs of 0.5 wt % is improved about 9.45%; a modulus of elasticity is improved about 21.24%; and a toughness is improved about 40%; a hardness is improved about 2.96%.

EXAMPLE 2 a method for making an aluminum-based composite material is provided. The components of the aluminum-based composite material are SiC and ADC12 aluminum alloy. The weight percentage of the SiC particles in the aluminum-based composite material is about 1.0 wt %. The method includes the following steps:

S211, providing 3 kilograms of ADC12 aluminum alloy and an electrical resistant furnace and;

S212, heating the ADC12 aluminum alloy to about 650° C. using the electrical resistant furnace;

S213, decreasing the temperature of the aluminum-based alloy to about 550° C. and keeping the ADC12 aluminum alloy at about 550° C. for 30 minutes to obtain a ADC12 aluminum alloy in semi-solid state;

S214, mechanically stirring the semi-solid ADC12 aluminum alloy and adding 30 grams of SiC particles into the ADC12 aluminum alloy during the ultrasonic stirring to obtain a mixture in semi-solid state;

S215, increasing the temperature of the mixture in semi-solid state to about 620° C. to obtain a mixture in liquid state;

S216, ultrasonically processing the liquid mixture under high intensity;

S217, increasing the temperature of the mixture in liquid state to about 660° C. and pouring the mixture in liquid state into a mold; and S218, cooling the mold to obtain the aluminum-based composite material.

In step S214, a speed of the ultrasonic stirring ranges from about 200 r/min to about 300 r/min, an average diameter of the SiC particles is about 40 nanometers. The SiC particles are preheated to about 300° C. before being added into the ADC12 aluminum alloy in semi-solid state. A time for adding the SiC particles is about 2 minutes. In step S216, a frequency of the ultrasonic processing is about 20 KHz, a maximum power output of the ultrasonic processing is about 1.4 KW, and a time of the ultrasonic processing is about 10 minutes.

In step S217, the mold is preheated to a temperature of about 210° C.

Compared to the ADC12 aluminum alloy, a tensile strength of the aluminum-based composite material including SiC particles of 1.0 wt % is improved about 12%; a modulus of elasticity is improved about 21.98%; and a toughness is improved about 49%; a hardness is improved about 4.83%.

EXAMPLE 3 a method for making an aluminum-based composite material is provided. The components of the aluminum-based composite material are SiC and ADC12 aluminum alloy. The weight percentage of the SiC in the aluminum-based composite material is about 1.5 wt %. The method includes the following steps:

S311, providing an electrical resistant furnace and 3 kilograms of ADC12 aluminum alloy.

S312, heating the ADC12 aluminum alloy to about 650° C. using the electrical resistant furnace;

S313, decreasing the temperature of the aluminum-based alloy to about 580° C. and keeping the ADC12 aluminum alloy at about 580° C. for about 30 minutes to obtain ADC12 aluminum alloy in semi-solid state;

S314, mechanically stirring the ADC12 aluminum alloy in semi-solid state and adding 45 grams of SiC particles into the ADC12 aluminum alloy during the ultrasonic stirring to obtain a mixture in semi-solid state;

S315, increasing the temperature of the mixture in semi-solid state to about 620° C. to obtain a mixture in liquid state;

S316, ultrasonically processing the mixture in liquid state under high intensity;

S317, increasing the temperature of the mixture in liquid state to about 670° C. and pouring the mixture in liquid state into a mold; and S318, cooling the mold to obtain the aluminum-based composite material.

In step S314, a speed of the ultrasonic stirring ranges from about 300 r/min to about 500 r/min, an average diameter of the SiC particles is about 40 nanometers. The SiC particles are preheated to about 300° C. before being added into the ADC12 aluminum alloy in semi-solid state. A time for adding the SiC particles is about 3 minutes. In step S316, a frequency of the ultrasonic processing is about 20 KHz, a maximum power output of the ultrasonic processing is about 1.4 KW, and a time of the ultrasonic processing is about 15 minutes.

In step S317, the mold is preheated to a temperature of about 210° C.

Figure 2:
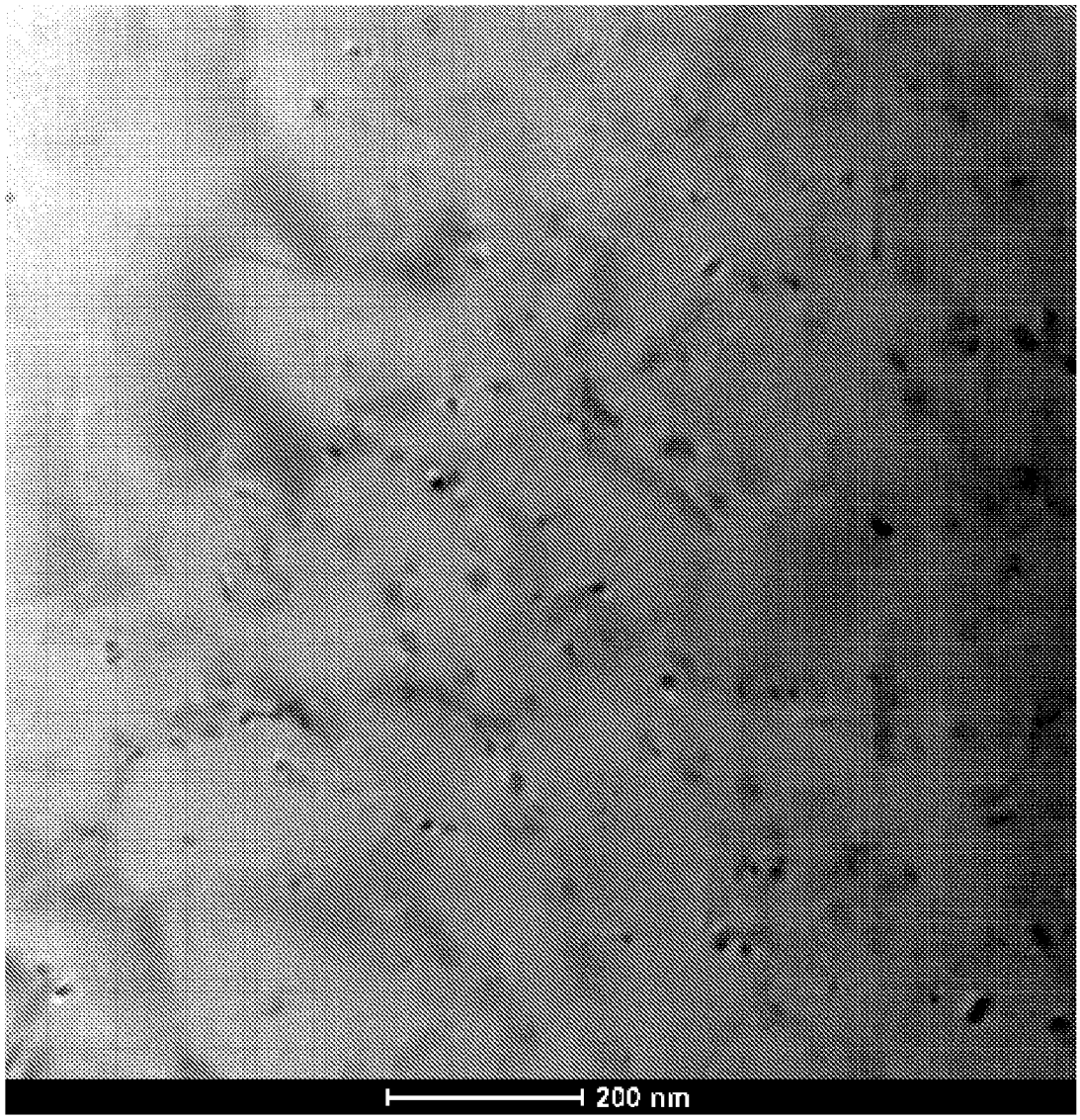
FIG. 2 illustrates a scanning electron microscope image of an embodiment of an aluminum-based composite material according to example 3.

Referring to FIG. 2, a plurality of SiC particles is dispersed in the aluminum-based composite material. The plurality of SiC particles is dispersed uniformly and does not aggregated. Compared to the ADC12 aluminum alloy, a tensile strength of the aluminum-based composite material including SiC particles of 1.5 wt % is improved about 14.33%; a modulus of elasticity is improved about 32.45%; and a strength is improved about 98.04%; a hardness is improved about 6.10%.

EXAMPLE 4 a method for making an aluminum-based composite material is provided. The components of the aluminum-based composite material are SiC and ADC12 aluminum alloy. The weight percentage of the SiC in the aluminum-based composite material is about 2.0 wt %. The method includes the following steps:

S411, providing an electrical resistant furnace and 3 kilograms of ADC12 aluminum alloy;

S412, heating the ADC12 aluminum alloy to about 650° C. using the electrical resistant furnace;

S413, decreasing the temperature of the aluminum-based alloy to about 550° C. and keeping the ADC12 aluminum alloy at about 550° C. for 30 minutes to obtain a ADC12 aluminum alloy in semi-solid state;

S414, mechanically stirring the ADC12 aluminum alloy in semi-solid state and adding 60 grams of SiC particles into the ADC12 aluminum alloy during the ultrasonic stirring to obtain a mixture in semi-solid state;

S415, increasing the temperature of the mixture in semi-solid state to about 620° C. to obtain a mixture in liquid state;

S416, ultrasonically processing the mixture in liquid state under high intensity;

S417, increasing the temperature of the mixture in liquid state to about 680° C. and pouring the mixture in liquid state into a mold; and S418, cooling the mold to obtain the aluminum-based composite material.

In step S414, a speed of the ultrasonic stirring ranges from about 300 r/min to about 500 r/min, an average diameter of the SiC particles is about 40 nanometers. The SiC particles are preheated to about 300° C. before being added into the ADC12 aluminum alloy in semi-solid state. A time for adding the SiC particles is about 5 minutes. In step S416, a frequency of the ultrasonic processing is about 20 KHz, a maximum power output of the ultrasonic processing is about 1.4 KW, and a time of the ultrasonic processing is about 15 minutes.

In step S417, the mold is preheated to a temperature of about 210° C.

Figure 3:
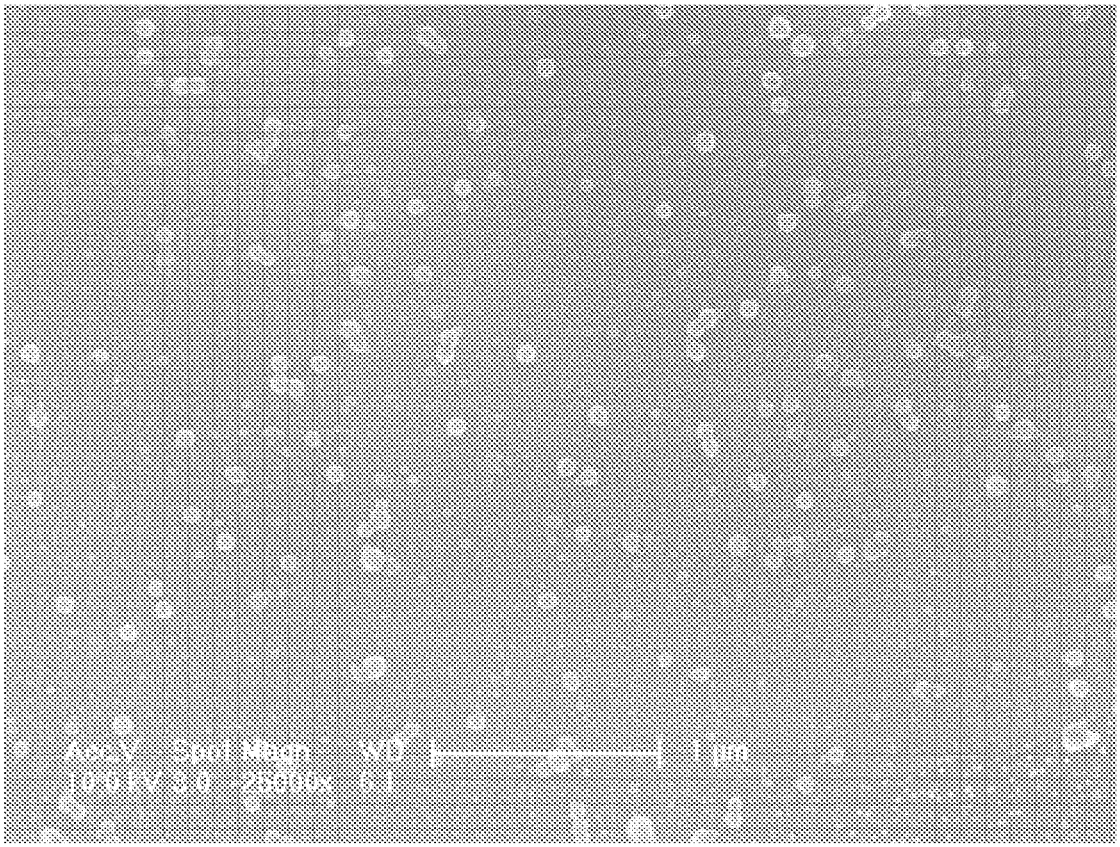
FIG. 3 illustrates a scanning electron microscope image of a fracture of an embodiment of an aluminum-based composite material according to example 4.

Referring to FIG. 3, a plurality of SiC particles is dispersed in the aluminum-based composite material. The plurality of SiC particles is dispersed uniformly and does not aggregate. Compared to the ADC12 aluminum alloy, a tensile strength of the aluminum-based composite material including SiCs of 2.0 wt % is improved about 22.87%; a modulus of elasticity is improved about 43.1%; and a toughness is improved about 155.88%; a hardness is improved about 7.38%.

When the aluminum-based material is in semi-solid state, the aluminum-based material is stirred and the nanoscale reinforcements are added into the aluminum-based material during the stirring process. Because the viscous resistance of the aluminum-based material in semi-solid state is high, the nanoscale reinforcements are astricted by the aluminum-based material and are hard to rise and fall. A swirl is produced when the aluminum-based material is stirred. Following the centrifugal force of the swirl motion, the nanoscale reinforcements can be dispersed into all the aluminum-based material uniformly. Furthermore, the aluminum-based material in semi-solid state is hard to be oxidized compared with the aluminum-based material in liquid state. After the aluminum-based composite material in liquid state is high intensity ultrasonically processed, the nanoscale reinforcements are dispersed into the aluminum-based composite material in both macroscopy and microcosmos.

Depending on the embodiments, certain of the steps described in the description and claims may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A method for making an aluminum-based composite material, the method comprises the steps of:

S10, making a semi-solid-state aluminum-based material with a predetermined viscosity capable of absorbing at least one nanoscale reinforcement uniformly within the semi-solid aluminum-base material;

S20, dispersing the at least one nanoscale reinforcement uniformly into the semi-solid-state aluminum-based material;

S20.1, assisting absorption of the at least one nanoscale reinforcement into the semi-solid-state aluminum-based material by stirring the semi-solid-state mixture at a controlled speed during the dispersing;

S20.2, obtaining a semi-solid-state mixture of the at least one nanoscale reinforcement uniformly dispersed in and completely absorbed by the semi-solid-state aluminum-based material;

S30, heating the mixture in semi-solid state to a liquid state;

S40, ultrasonically processing the mixture in liquid state; and

S50, cooling the mixture in liquid state.

2. The method of claim 1, wherein the aluminum-based material is a pure aluminum.

3. The method of claim 1, wherein the aluminum-based material is an aluminum-based alloy, and the aluminum-based alloy comprises aluminum and other metals selected from the group consisting of zinc, manganese, aluminum, thorium, lithium, silver, calcium, and any combinations thereof.

4. The method of claim 1, wherein making of the semi-solid-state aluminum-based material is carried out in a vacuum environment.

5. The method of claim 1, wherein making of the semi-solid-state aluminum-based material is is carried out in a protective gas environment, and the protective gas is a noble gas.

6. The method of claim 5, wherein the step S10 comprises substeps of:

S101, providing a aluminum-based material in solid state;

S102, heating the aluminum-based material in solid state to a temperature between a liquidus line and a solidus line of the aluminum-based material in the protective gas to obtain a aluminum-based material in semi-solid state preform; and S103, keeping the aluminum-based material preform in semi-solid state at the temperature for a period of time.

7. The method of claim 5, wherein the step S10 comprises substeps of:

providing a aluminum-based material in solid state;

heating the aluminum-based material in solid state to obtain a aluminum-based material in liquid state;

decreasing the temperature of the aluminum-based material to a temperature, wherein the second temperature is between the liquidus line and a solidus line of the aluminum-based material.

8. The method of claim 1, wherein the at least one nanoscale reinforcement comprises material selected from the group consisting of carbon nanotubes, silicon carbides, aluminum oxides, boron carbides and any combinations thereof.

9. The method of claim 8, wherein the at least one nanoscale reinforcement is carbon nanotube.

10. The method of claim 9, wherein an outer diameter of each carbon nanotube ranges from about 10 nanometers to about 50 nanometers, and a length of each carbon nanotube ranges from about 0.1 micrometers to about 50 micrometers.

11. The method of claim 1, wherein the at least one nanoscale reinforcement is particle with a diameter ranging from about 1.0 nanometer to about 100 nanometers, a weight percentage of the nanoscale reinforcements in the mixture is about 0.5% to about 2.0%.

12. The method of claim 1, wherein during a process of dispersing the at least one nanoscale reinforcement, the aluminum-based material in semi-solid state is stirred.

13. The method of claim 12, wherein the aluminum-based material in semi-solid state is stirred by an ultrasonic stirring or an electromagnetic stirring.

14. The method of claim 1, wherein a frequency of the ultrasonic processing ranges from about 15 KHz to about 20 KHz.

15. The method of claim 1, wherein the at least one nanoscale reinforcement comprises a plurality of nanoscale reinforcements, and each of the nanoscale reinforcements is enclosed in and directly in contact with the semi-solid-state aluminum-based material.

16. The method of claim 1, wherein the step of cooling the mixture in liquid-state comprises the following substeps of:

increasing the temperature of the liquid-state mixture to a pouring temperature;

pouring the mixture in liquid state into a mold; and cooling the mold.

17. The method of claim 16, wherein the mold is preheated to a temperature ranging from about 200° C. to about 300° C.

18. The method of claim 16, wherein the pouring temperature ranges from about 650° C. to about 680° C.

19. A method for making an aluminum-based composite material, the method comprises the steps of:

making a semi-solid-state aluminum-based material with a predetermined viscosity capable of absorbing at least one nanoscale reinforcement uniformly within the semi-solid aluminum-base material in a protective gas environment or a vacuum environment;

dispersing the at least one nanoscale reinforcement uniformly into the semi-solid-state aluminum-based material;

assisting absorption of the at least one nanoscale reinforcement into the semi-solid-state aluminum-based material by stirring the semi-solid-state mixture at a controlled speed during the dispersing;

obtaining a semi-solid-state mixture of the at least one nanoscale reinforcement uniformly dispersed in and completely absorbed by the semi-solid-state aluminum-based material;

heating the mixture in semi-solid state to a liquid state;

ultrasonically processing the mixture in liquid state; and cooling the mixture in liquid state.

* * * * *